US005423363A

United States Patent [19]

Matzdorff et al.

[11] Patent Number: 5,423,363

[45] Date of Patent: Jun. 13, 1995

[54] ADJUSTABLE STRAP FOR FOLDABLE WALLET

[75] Inventors: Gary Matzdorff, Vernon; Jeffry A. Matzdorff, Lomita, both of Calif.

[73] Assignee: Gary's Leather Creations, Vernon, Calif.

[21] Appl. No.: 106,355

[22] Filed: Aug. 13, 1993

[51] Int. Cl.[6] ..... A45C 1/06; A45C 13/10

[52] U.S. Cl. ..... 150/143; 150/149; 190/119; 190/901

[58] Field of Search ..... 150/118, 132–134, 150/142, 143, 149; 190/103, 119, 900, 901

[56] References Cited

U.S. PATENT DOCUMENTS

| | | | |
|---|---|---|---|
| 442,231 | 12/1890 | Lieker | 150/118 |
| 932,205 | 8/1909 | Wentz | 150/143 X |
| 1,026,787 | 5/1912 | Collis | 150/143 |
| 1,561,343 | 11/1925 | Michaels | 150/143 |
| 2,350,503 | 6/1944 | Gardner | 150/143 |
| 2,369,864 | 2/1945 | Spaldo | 150/143 |
| 2,589,481 | 3/1952 | Dobbs et al. | 150/143 |
| 2,592,046 | 4/1952 | Leue et al. | 150/132 |
| 2,651,346 | 9/1953 | Nash | 150/143 |
| 2,839,114 | 6/1958 | Moscowitz et al. | 150/143 X |
| 2,908,306 | 10/1959 | Chorost | 150/134 |
| 3,292,225 | 12/1966 | Burniski | 150/132 X |
| 4,332,338 | 6/1982 | Christiansen | 150/143 X |
| 4,907,634 | 3/1990 | Yoo | 150/143 |

FOREIGN PATENT DOCUMENTS

| | | | |
|---|---|---|---|
| 1246833 | 10/1960 | France | 150/118 |
| 103399 | 1/1917 | United Kingdom | 150/132 |
| 234988 | 6/1925 | United Kingdom | 150/188 |

*Primary Examiner*—Sue A. Weaver

*Attorney, Agent, or Firm*—Blakely, Sokoloff, Taylor & Zafman

[57] ABSTRACT

A foldable holding device comprising an outer layer and an inner layer which is fixedly secured to the outer layer. The device is adjustably secured in a folded position by a self-contained adjustable strap assembly interposed between the inner and outer layers, where the strap assembly comprising a strap horizontally interposed between two semi-rigid members. The strap including an elastic and inelastic portion where one end of the elastic strap portion is coupled to the semi-rigid member and the other is coupled to the inelastic strap portion.

10 Claims, 1 Drawing Sheet

FIG. 1
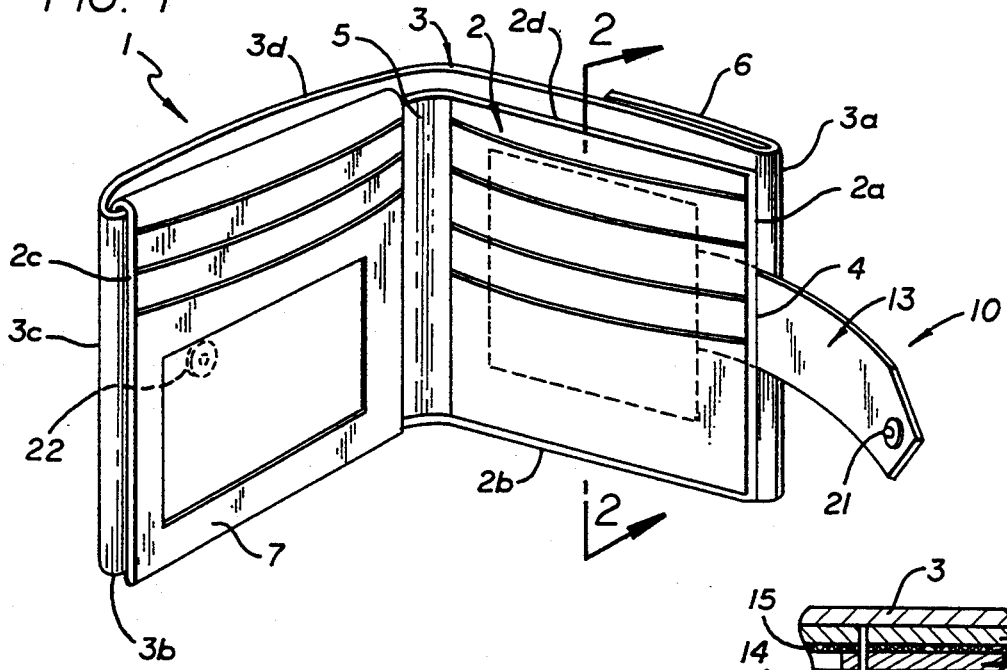
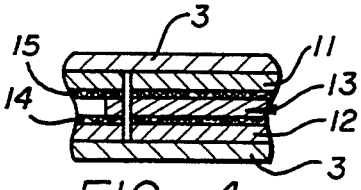
FIG. 4
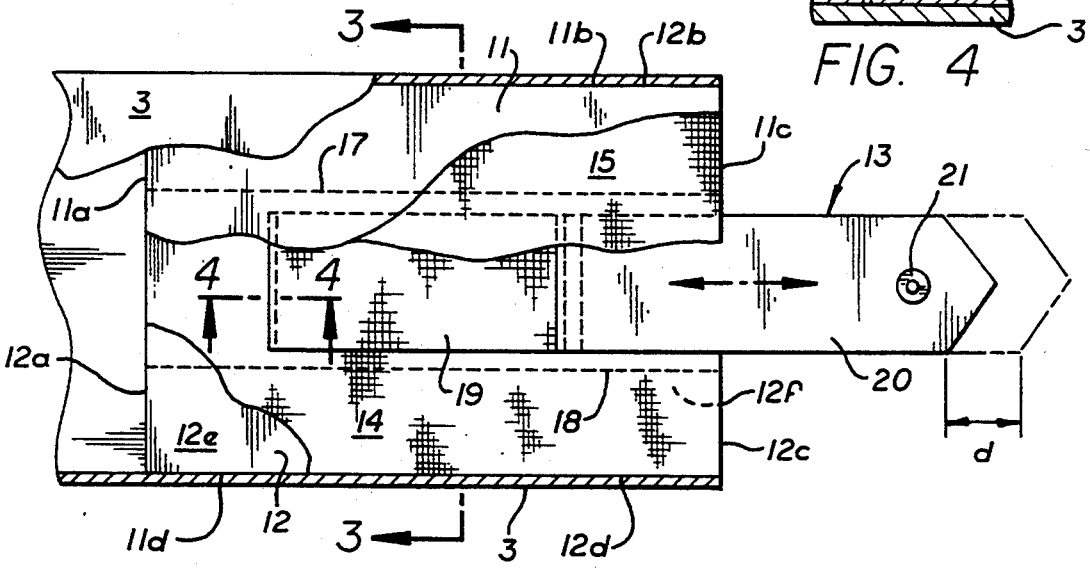
FIG. 2
FIG. 3
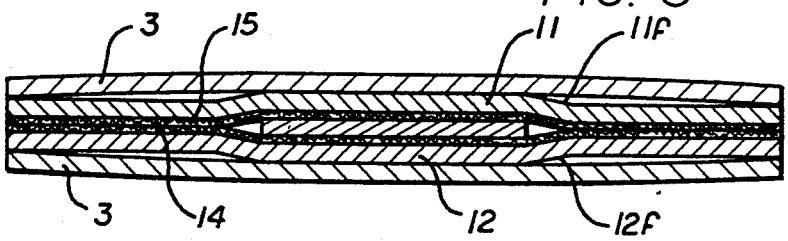

ADJUSTABLE STRAP FOR FOLDABLE WALLET

BACKGROUND OF THE INVENTION

1. Field of the Invention

The present invention relates to a foldable holding device such as a wallet, diary, checkbook or other foldable item, and more particularly, to a self-contained adjustable strap assembly to maintain the above items in a folded position. Although the present invention is described in its use with wallets, many of the most important features have general application and are not intended to be limited for use only with the same.

2. Description of the Prior Art and Related Information

Wallets with folding capabilities are popular for both men and women. Such wallets provide at least one elongated pocket with an opening along its upper horizontal edge and extending the full length thereof for containing currency, checks, receipts or other similar items. Since most folding wallets are carried either on a person or in a handbag, they are normally made as thin as possible to reduce bulk. As a result, as the pocket is filled, the wallet begins to expand widthwise thereby making it difficult to maintain its folded position and uncomfortable to carry due to its unwieldy nature.

In response to these difficulties, straps were implemented on the wallets to enable a person to fold his or her wallet when it is full. For example, U.S. Pat. No. 2,651,346 to Nash discloses a wallet having an adjustable strap positioned between an inner sheet and an outer sheet of the wallet. The strap has an elastic and inelastic portion whereby the elastic portion is secured to both the inner sheet and the inelastic portion. A slot in the outer sheet provides such width as to permit the body of the strap to pass therethrough but not the head of the strap. Although this invention provides a strap for maintaining a wallet in its folded position, no provision is made to incorporate a self-contained adjustable strap assembly wherein the strap is interposed between two semi-rigid members for ease in manufacture and for additional strength.

Also, U.S. Pat. No. 2,369,684 to Spaldo discloses a book cover which incorporates an adjustable strap having an elastic strip secured to the inner end of the strap. Similar to the Nash reference briefly described above, the elastic strip is anchored to the wallet's surface. No provision is made for a self-contained adjustable strap assembly as disclosed in the present application.

For these straps which were designed to be adjustable, there were a number of disadvantages. The primary disadvantage is that the straps are commonly connected directly to a surface of the wallet so that constant use of the strap erodes the surface wallet and thus, shortens the life of the wallet. Another disadvantage is that it is difficult to manufacture such a wallet or similar product since the strap is not provided in a self contained assembly which can be easily installed and where the adjustable strap is secured to surfaces other than that of the wallet or other product.

Thus, there is a need for a better adjustable strap assembly for maintaining the wallet or any foldable device in its folded position which does not have the same disadvantages as the prior art references.

SUMMARY OF THE INVENTION

It is an object of the present invention to provide a device which can maintain a foldable holding device in a folded position.

It is also an object of the present invention to provide a self-contained adjustable strap assembly for a foldable holding device which does not erode the surface of the wallet through continuous use and provides superior strength and endurance because it is not secured directly to the wallet surface.

It is a further object of the present invention to provide an adjustable strap which is inexpensive to implement and manufacture.

It is yet another object of the present invention to provide a device which can maintain the wallet in the folded position in order to avoid loss of articles contained therein.

These and other objects of the present invention are provided in a foldable holding device comprising an outer layer and an inner layer which is fixedly secured to the outer layer. The holding device is adjustably secured in a folded position by a self-contained adjustable strap assembly interposed between the inner and outer layers. The strap assembly includes a strap having an elastic and inelastic portions horizontally placed between two semi-rigid members. One end of the elastic strap portion is coupled to the semi-rigid members and the other is coupled to the inelastic strap portion. The inelastic portion is partly disposed within the strap assembly.

Many other advantages, factors and additional objects will become apparent to those skilled in the art upon making reference to the detailed description and the accompanying drawings in which certain embodiments incorporating the present invention are shown by way of illustration.

BRIEF DESCRIPTION OF THE DRAWINGS

The object, features and advantages of the present invention will become apparent from the following detailed description of the preferred embodiment in which:

FIG. 1 is a prospective view a wallet in its unfolded position having the present invention.

FIG. 2 is a peel away view of the present invention through line 2—2 of FIG. 1.

FIG. 3 is a sectional view of the present invention through line 3—3 in FIG. 2.

FIG. 4 is a sectional view of the present invention through line 4—4 in FIG. 2.

DETAILED DESCRIPTION OF THE INVENTION

A device is described which is useful in maintaining a wallet, diary, checkbook or any other foldable item in its folded position when containing several flexible items such as paper products, currently and receipts. The preferred embodiment of the present invention might best be described as a self-contained adjustable strap assembly which is used to maintain any foldable item in a folded state. It should be born in mind that the present invention need not be limited in use for wallets, or even money-holding articles in general. The present invention may find wide application in diaries, checkbooks or any other foldable product which is difficult to fold when full.

Referring to FIG. 1, the preferred embodiment of a self-contained adjustable strap assembly 10 is illustrated within a foldable wallet 1. The wallet 1 comprises an inner layer 2 and an outer layer 3. Both layers 2 and 3 are aligned and attached together along their four edges 2a–2d and 3a–3d but leaving a gap 4 between edges 2a and 3a of the wallet 1. As in most conventional wallets and shown in FIG. 1 by dual parallel lines about its periphery, the inner and outer layers 2 and 3 include multiple sheets. Preferably, the strap assembly 10 is disposed between the inner and outer layers 2 and 3 and, more particularly, between the multiple sheets of the outer layer 3.

This gap 4 is of sufficient width and length to allow a strap 13 to pass therethrough. A foldline 5 is positioned substantially equidistant from edges 2a, 2c, 3a and 3c and perpendicular to edges 2b, 2d, 3b and 3d to form two halved areas of each layer. In a folded state, the halved areas of the inner layer directly oppose one another. The wallet further includes a pocket 6 connected with the outer layer 3 to hold change and other small objects, and an identification flap 7 attached to the inner layer 2 so as to be pivoted in a direction perpendicular to the fold line 5.

As shown in FIG. 2, the self-contained adjustable strap assembly comprises a pair of semi-rigid members 11 and 12 each of which has four edges 11a–11d and 12a–12d as well as an interior and exterior surface 11e–11f and 12e–12f and with a strap 13 interposed therebetween. The exterior surfaces 11f and 12f of the semi-rigid members 11 and 12 are affixed to the multiple sheets of the outer layer 3 by any other conventional affixing method. Each of the semi-rigid members has a length and width less than one-half the length of the layers 2 and 3 as illustrated by dashed lines in FIG. 1. The semi-rigid members are illustrated in more detail in FIGS. 3 and 4.

In FIG. 3, the semi-rigid members 11 and 12 are made from cardboard, paper or any other semi-rigid material. The interior surface of the members 11e and 12e are preferably lined with fabric 15 and 14 such as nylon in order to reduce wear on the members 11 and 12 from prolonged adjustment of the strap 13. The semi-rigid members 11 and 12 are aligned and attached together proximate to at least one vertical edge 11a and 12a by stitching or the like. However, in its preferred embodiment, the members are also attached together by gluing its horizontal edges and stitching horizontally across the members 17 and 18 as shown in FIG. 2.

Referring back to FIG. 2, such stitching 17 and 18 operates as a guide for the strap 13 so that it will not deviate from its intended horizontal direction. The strap 13 is horizontally disposed between the members 11 and 12 includes an elastic portion 19 and an inelastic portion 20. As shown in FIG. 4, the elastic strap portion 19 is coupled at one end to both the members 11 and 12 and the linings 15 and 14 proximate to the edge 11a and 12a and to the inelastic strap portion 20 at the other end. The elastic strap portion 19 has an elasticity which is sufficient to allow it to expand a distance "d" without breaking or tearing. The distance "d" is approximately equal to one inch but could be greater or lesser depending on the desired elasticity.

The inelastic strap portion 20 is connected to the elastic strap portion 19 and is disposed only partially within the members 11 and 12. The strap portion has a male connector 21 disposed thereon to connect to a female connection 22 disposed on the halved area of the outer layer bordered by the edges 3b, 3c and 3d as shown in FIG. 1. The inelastic strap portion 20 is made of the same material as the outer layer 3.

When using the self-contained adjustable strap assembly to fasten the wallet in a folded position, the strap 13 is pulled horizontally a sufficient distance to enable the male connector 21 to attach to the female connection 22. The horizontal stitching 17 and 18 provide a specific gap in order to restrict the strap 13 from moving in a direction other than substantially horizontal. Such horizontal stitching also prevents the strap 13 from becoming twisted or overly stretched which would cause a decrease in the elasticity of the elastic strap portion 19 and, in this connection, would decrease the effectiveness of the self-contained adjustable strap assembly 10.

The self contained adjustable strap assembly 10 described herein may be manufactured by many different methods and materials. Various adjustable strap assemblies may be provided to accommodate different foldable products such as diaries, checkbooks and the like. While the present invention has been described in terms of a preferred embodiment, other embodiments may come to mind to those skilled in the art without departing from the spirit and scope of the present invention. The invention should, therefore, be measured in terms of the claims which follow.

What is claimed is:

1. A foldable holding device comprising an outer layer including a first and second sheets and an inner layer which is fixedly secured to the outer layer, said device is adjustably secured in a folded position by a self-contained adjustable strap assembly interposed between and affixed to the first and second sheets, said strap assembly comprising a strap horizontally interposed between and attached to two semi-rigid members, said strap including an elastic strap portion positioned between said two semi-rigid members and an inelastic strap portion, having a first coupling element, protruding from the two semi-rigid members where one end of the elastic strap portion is coupled to the semi-rigid members and the other end of the elastic strap portion is coupled to the inelastic strap portion, wherein in a folded position, the first coupling element of the inelastic strap portion is coupled to a second coupling element attached to the second sheet.

2. The foldable holding device according to claim 1, wherein said inner layer and outer layer are aligned and fixedly secured proximate to at least one edge of said layers.

3. The foldable holding device according to claim 2, wherein the semi-rigid members are further horizontally attached together above and below the strap so as to provide a defined horizontal gap between the semi-rigid members.

4. The foldable holding device according to claim 3, wherein the second coupling element is a female connector.

5. The foldable holding device according to claim 4, wherein the first coupling element includes a male connector disposed on the inelastic strap portion to be inserted into the second coupling element.

6. The foldable holding device according to claim 1, wherein the semi-rigid members are less than one-half the length of the outer and inner layers.

7. The foldable holding device according to claim 1, wherein a first semi-rigid member is made of cardboard.

8. A foldable holding device comprising (i) a rectangular outer layer having a predetermined fold line between a first area having a first coupling element and a second area of the outer layer with a self-contained adjustable strap assembly coupled to and protruding from said second area of the outer layer and (ii) a rectangular inner layer, fixedly secured to said outer layer, having a fold line between a third area and a fourth area of the inner layer where said third area is directly opposite said fourth area when the device is in a folded state, said device being maintained in the folded state by connecting said first coupling element of the outer layer to a second coupling element of said self-contained adjustable strap assembly, said strap assembly comprising:

at least two semi-rigid members having both an interior and exterior surface;

means for reducing wear on said semi-rigid members, said reducing means being coupled to each interior surface of the semi-rigid members, wherein the at least two semi-rigid members with the reducing means are aligned and couple together about one edge; and a strap horizontally interposed between said reducing means, said strap including an elastic and inelastic portion having said second coupling element where one end of the elastic portion is coupled with the reducing means and the at least two semi-rigid members about said one edge and the other end of the elastic portion is connected to the inelastic portion partially enclosed between the at least two semi-rigid members and the reducing means.

9. The foldable holding device according to claim 8, wherein said reducing means comprises a lining of fabric positioned been the strap and each of said two semi-rigid members.

10. A foldable holding device comprising (i) a rectangular outer layer having a predetermined fold line between a first area having a first coupling element and a second area of the outer layer with a self-contained adjustable strap assembly coupled to and protruding from said second area of the outer layer and a rectangular inner layer, fixedly secured to said outer layer, having a fold line between a third area and a fourth area of the inner layer where said third area is directly opposite said fourth area when the device is in a folded state, said device being maintained in the folded state by securing said first coupling element to a second coupling element of said self-contained adjustable strap assembly, said self-contained strap assembly comprising:

two four-sided semi-rigid members having an interior and exterior surface;

two linings made of fabric, each of the two linings being attached to the interior surfaces of the two semi-rigid members, respectively, wherein said two semi-rigid members with said linings are aligned and completely attached about a first, second and third edges and only partially attached at a fourth edge so as to leave a gap between said two semi-rigid members, said two semi-rigid members are further coupled together by horizontal stitches; and a strap horizontally interposed between the two linings and positioned between the horizontal stitches of said semi-rigid members, said strap includes an elastic and inelastic portion having said second coupling element where one end of the elastic portion is coupled with the linings and the other end of the elastic portion is connected to the inelastic portion partially enclosed between said two semi-rigid members.

* * * * *

UNITED STATES PATENT AND TRADEMARK OFFICE

CERTIFICATE OF CORRECTION

PATENT NO. : 5,423,363

DATED : June 13, 1995

INVENTOR(S) : Matzdorff et al.

It is certified that error appears in the above-identified patent and that said Letters Patent is hereby corrected as shown below:

In Claim 10 in column 6 at line 4 change "of the outer layer and a rectangular" to --of the outer layer and (ii) a rectangular--

Signed and Sealed this

Seventh Day of November, 1995

*Attest:*

*Attesting Officer*

BRUCE LEHMAN

*Commissioner of Patents and Trademarks*